United States Patent [19]

Ogawa

[11] Patent Number: 4,857,905

[45] Date of Patent: Aug. 15, 1989

[54] IMAGE DISPLAY APPARATUS

[75] Inventor: Toru Ogawa, Edogawa, Japan

[73] Assignee: Namco, Ltd., Tokyo, Japan

[21] Appl. No.: 150,908

[22] Filed: Feb. 1, 1988

[30] Foreign Application Priority Data

Feb. 5, 1987 [JP] Japan ..... 62-25672

[51] Int. Cl.[4] ..... G09G 1/16

[52] U.S. Cl. ..... 340/748; 340/703; 340/750

[58] Field of Search ..... 340/703, 721, 748, 750, 340/799

[56] References Cited

U.S. PATENT DOCUMENTS

| | | | |
|---|---|---|---|
| 4,649,377 | 3/1987 | Urabe | 340/749 |
| 4,691,295 | 9/1987 | Erwin et al. | 340/750 |
| 4,703,438 | 10/1987 | Nishiyama et al. | 340/750 |
| 4,757,309 | 7/1988 | Bowater et al. | 340/703 |

*Primary Examiner*—Gerald Brigance

*Attorney, Agent, or Firm*—Oliff & Berridge

[57] ABSTRACT

An image display apparatus which synthesizes one color picture by placing a plurality of pictures with one on top of another. Only one shape generator and one character generator are provided for common use in synthesizing one color picture by placing the plurality of pictures with one on top of another. Each of the plurality of pictures is stored in a dedicated V-ram and is fed to the common shape generator and character generator via a priority decision circuit.

13 Claims, 15 Drawing Sheets

| FIG. 1A |
| --- |
| FIG. 1B |

| FIG. 3A | FIG. 3B |
|---|---|

| FIG. 4A | FIG. 4B |
|---|---|

| FIG. 11A |
| --- |
| FIG. 11B |

IMAGE DISPLAY APPARATUS

BACKGROUND OF THE INVENTION

1. Field of the Invention

The present invention relates to an image display apparatus and, more particularly, to an image display apparatus for synthesizing one color picture from a plurality of overlapping pictures and outputting the synthesized picture.

2. Description of the Prior Art

Image display apparatus which adopt a dot-map-display system or a character block system have convectionally been known and widely used for synthesizing and outputting various pictures to be displayed on a CRT.

As is known, a picture displayed on a CRT for games is generally composed of 224 horizontal scanning lines, and each line is composed of picture elements of 288 dots. One picture of such a picture to be displayed on a CRT is therefore composed of picture elements of 288×224 dots, and in order to display 256 colors on the CRT, it is necessary that a color corresponds to color data of 8 bits which designate the color for each dot.

Dot-map-memory system

Accordingly, if an image display apparatus of a dot-map-memory system is used, a dot-map-memory of as large a capacity as 288 (the number of dots per line)×224 (the number of horizontal scanning lines)×8 (color code) is inconveniently necessary in order to display one picture.

Especially, when the size of the picture of the object of display is larger than the size of the screen of the CRT, the picture to be displayed on the CRT is often selected by scrolling vertically and horizontally in the scroll reference picture which displays the object of display.

In the case where the picture to be displayed on the CRT (hereinunder referred to as "CRT display picture") is determined while scrolling in this way, it is often the case that the scroll reference picture has such a large square configuration as 512×512 dots. If a color code of 8 bits is set for each dot of such a large scroll reference picture, the capacity of the dot-map-memory becomes disadvantageously large.

Character block system

In contrast, in an image display apparatus of a character block system, a picture to be displayed on a CRT is divided into a plurality of character blocks, so that the CRT display picture is efficiently synthesized and output with a memory of a small capacity. The present invention relates to an image display apparatus of this system.

For example, if a CRT display picture is divided by a unit of a character block 100 of an 8 dot×8 dot square, as shown in FIG. 7(B), the CRT display picture is divided vertically into 36 blocks and horizontally 28 blocks, namely, into 36×28 character blocks in total, as shown in FIG. 7(A).

FIG. 8 shows the principle of an image display apparatus of a character block system in the prior art which has been widely used. The image display apparatus is provided with a character generator 10 in which a plural items of character data are registered in advance which are to be displayed in the corresponding character block 100.

FIGS. 9(A) to 9(C) respectively show examples of color data registered in advance in the character generator 10. Each item of character data is composed as an item of color data which fills in the character block 100 of 8 dots×8 dots.

Therefore, if a picture is synthesized by filling an appropriate character such as those shown in FIGS. 9(A) to 9(C) in the corresponding character block 100 of the CRT display picture shown in FIG. 7(A), it is possible to form a picture efficiently with a memory of a small capacity.

In order to form such a picture, the above-described conventional apparatus includes a video RAM 12 serving as a picture display memory, a CRT controller 14 and a latch circuit 16. To the video RAM 12, addresses corresponding to the respective character blocks 100-1, 100-2, . . . of the CRT display picture shown in FIG. 7(A) are assigned, and an address for reading a color character which is to be displayed in the corresponding character block is registered in each character block address.

The CRT controller 14 outputs a character block address signal 200 in synchronization with horizontal and vertical scans of the CRT. The video RAM 12 then reads a color character read address signal 210 which has been registered in advance and outputs it to the character generator 10 through the latch circuit 16.

Therefore, the character generator 10 outputs the color character data designated by the read address signal 210 to a parallel-serial conversion circuit 18.

Each item of character color data registered in the character generator 10 is composed of a combination of 8 lines of horizontal scanning information, each line consisting of 8 dots, as shown in FIGS. 9(A) to 9(C).

The CRT controller 12 therefore outputs a vertical scanning position address signal 220 in each character block 100 to the character generator 10 in synchronization with the horizontal and vertical scans.

Accordingly, when an item of character color data such as that shown in FIG. 9 is designated by the character read address 210, the color character data for one line which is designated by the vertical scanning position address signal 220 is read from the character generator 10 to the parallel-serial conversion circuit 18. The thus-read out color character data for one line (A) is output as a video signal 230 in synchronization with the horizontal scan of the CRT.

For example, when the color character shown in FIG. 9(A) is displayed in the character block 100-1 shown in FIG. 7(A), the CRT controller 14 outputs the character block address signal 200 which designates the character block 100-1 to the video RAM 12. The video RAM 12 outputs the color character read address signal 210 for reading the color character data shown in FIG. 9(A) to the character generator 10 through the latch circuit 16.

At this time, if the third horizontal scan of the character block 100-1 of the CRT, for example, has already been begun, the CRT controller 14 outputs the vertical scanning position address signal 220 which indicates the third line scan to the character generator 10. The character generator 10 outputs the data at the third line of the color character data shown in FIG. 9(A) to the parallel-serial conversion circuit 18 as a parallel signal.

The parallel-serial conversion circuit 18 consecutively outputs an item of character color data for one line as a video signal 230 for each dot in synchronization with the horizontal scan of the CRT.

When the horizontal scan of the eighth dot of the CRT is finished in this way, the CRT controller 14 outputs the address signal 200 which designates the next character block 100-2 to the video RAM 12 in the same way, and the vertical scanning position address 220 which indicates the horizontal scan of the third line to the character generator 10 in the same way.

The character generator 10 therefore outputs the character color data at the third line of the character block 100-2 as the video signal 230 through the parallel-serial conversion circuit 18.

In this way, since this image display apparatus has a structure in which color character data to be used are registered in the character generator 10 in advance and only the color character read addresses 210 for the color characters to be displayed in the corresponding character blocks are registered in the video RAM 12, the memory capacity of the video RAM 12 is much smaller than that of the image display apparatus of the dot-map-display system, and the structure of the image display apparatus is simplified in comparison with that of the image picture display apparatus of the dot-map-display system.

Overlapping display

Such an image display apparatus of a character block system is often used for synthesizing on color picture by placing a plurality of pictures with one on top of another. For example, the image display apparatus is used for laying a top picture 300-1 on a bottom picture 300-2 for displaying a synthesized picture 400.

FIG. 11 shows an example of such an image display apparatus for synthesizing a picture by placing a plurality of pictures with one on top of another. The same numerals are provided for the elements which correspond to those shown in FIG. 8, and explanation thereof will be omitted.

When one picture is synthesized from three overlapping pictures 300-1, 300-2 and 300-3, as shown in FIG. 12, the three pictures are generally formed by using three picture formation circuits 500-1, 500-2 and 500-3. The video signals 230-0, 230-1 and 230-2 which are output from the respective picture formation circuits 500-0, 500-1 and 500-2 are output to a priority decision circuit 20.

The priority decision circuit 20 compares the video signals 230-0, 230-1 and 230-2 in each dot which are output from the respective picture formation circuits 500-0, 500-1 and 500-2 in accordance with predetermined priorities, and the signal which is judged to have the highest priority is output as a video signal 240 for picture synthesis.

For example, if it is assumed that the pictures are determined to have a priority in the order of 300-0, 300-1, and 300-2, and character codes "0008H", "0009H" and "000AH" which correspond to the character data shown in FIGS. 9(A), 9(B) and 9(C), respectively, are respectively registered in the first character blocks of the respective pictures, the color characters are displayed in the first character block 100-1 of the CRT display picture which is indicated by the video signal 240 with the color characters placed with one on top of another in the order of priority, as shown in FIG. 13.

Thus, it will be understood that the conventional image display apparatus of a character block system is very suitable for synthesizing one picture from a plurality of overlapping pictures, because the memory capacity (capacity of the video RAM) required for synthesizing one picture is very small.

Such a conventional image display apparatus of a character block system, however, involves various problems which will be described in detail hereinunder, and the effective countermeasures have been in demand.

(A) The character generator 10 has multiple items of registered color character data for color characters to be displayed in the character blocks 100 of each picture registered, as described above. To the color character data registered in the character generator 10, color information of 8 bits is assigned for every $8\times8$-bit picture element which constitutes the character block 100. Consequently, at least a memory capacity of $8\times8\times8=512$ bits is required for registering one item of color character, and as the number of items of color character data registered increases, a memory region of the larger capacity is required, and the apparatus itself becomes the more expensive.

Nevertheless, the conventional image display apparatus is provided with the character generators 10-0, 10-1 and 10-2 exclusively for the picture formation circuits 500-0 500-1 and 500-2, respectively, which are used for forming the respective pictures. The whole apparatus therefore becomes very expensive.

Especially, as the number of the overlapping pictures increases in the conventional apparatus, the number of the character generators 10 also increases, so that the whole apparatus disadvantageously becomes even more expensive.

(B) Since the same color character data are often registered in the different character generators 10-0, 10-1, 10-2, . . . which are provided exclusively for the picture formation circuits 500-0, 500-1 500-2, . . . , as described above, it is impossible to utilize the memory space in the character generator 10 with efficiency.

(C) Since the color generators 10-0, 10-1, 10-2 . . . , are provided exclusively for the picture formation circuits 500-0, 500-1, 500-2, . . . respectively, the space which the character generators 10 occupy in the apparatus becomes comparatively large, resulting in large restriction in efficient arrangement of circuitry.

(D) 8-bit color information for each dot is output from the respective picture formation circuits 500-0, 500-1, 500-2, . . . of the conventional apparatus as the video signal 230.

It is therefore necessary that the priority decision circuit 20 compares 8-bit color data in each dot in order to determine the priorities of the video signals 230 output from the respective picture formation circuits 500-0, 500-1, 500-2, . . . , and the circuitry structure of the priority decision circuit 20 becomes complicated and, in addition, processing of determining the priority takes a long time.

SUMMARY OF THE INVENTION

Accordingly, it is an object of the present invention to eliminate the above-described problems in the prior art and to provide an image display apparatus which is provided with one character generator for common use in synthesizing one color picture by placing a plurality of pictures with one on top of another, thereby enabling reduction in cost.

To achieve this aim, the present invention provides a picture display apparatus for synthesizing one color picture by placing a plurality of pictures with one on top of another, comprising: a picture display memory for dividing each of the pictures before synthesis into a plurality of character blocks, and registering addresses for reading the color characters to be displayed in the respective character blocks at the respective character block addresses; a raster display controller for successively outputting the character block address signals of the respective pictures before synthesis to said picture display memory in synchronization with horizontal and vertical scans of a raster display so that said picture display memory successively outputs the corresponding character read address signals in the numerical order of said pictures, and for successively outputting vertical scanning position address signals for the corresponding character blocks of the respective pictures; a shape generator in which a plurality of character shapes to be displayed in the respective character blocks are registered in advance, and which outputs, in the numerical order of said pictures, character shape data for one horizontal scan of the character blocks which are designated by the corresponding vertical scanning position address signals in accordance with the character shapes designated by the corresponding character read address signals which are successively input in the numerical order of the pictures before synthesis; a priority decision circuit for comparing the character shape data for one horizontal scan which are output from the shape generator in the numerical order of the pictures with each other in accordance with predetermined priorities and determining the priority picture for each dot which is to be displayed at the time of a horizontal scan of the raster display; and a character generator in which a plurality of color character data to be displayed in the respective character blocks are registered in advance, and which successively outputs color data for one dot which are specified by the corresponding vertical scanning position address signal and a horizontal scanning position address signal in accordance with the color character data designated by the character read address of the priority picture in synchronization with a scan of the raster display. The present invention is characterized in that only one shape generator and one character generator are provided for common use in synthesizing one color picture by placing the plurality of pictures with one on top of another.

According to the present invention having the above-described structure, since only one character generator is necessary for synthesizing one color picture from a plurality of overlapping pictures, reduction in the cost of the apparatus as a whole is enabled.

According to the present invention, there is no problem of the same color character data being registered in a plurality of character generators as in the prior art, so that effective use of the memory space of the character generator is enabled.

Furthermore, since the image display apparatus according to the present invention is sufficed with only one character generator, the space in the apparatus occupied by the character generator is small. In particular, when a multiplicity of pictures are placed with one on top of another for synthesis of one color picture, the space occupied by the character generator is much smaller than that in the conventional apparatus, thereby enabling efficient arrangement of circuitry.

In addition, according to the present invention, only the shape data (data including no color information) output from a shape generator are compared with each other in accordance with predetermined priorities in order to determine the priorities of the plurality of pictures which are displayed in an overlapping state in each dot. The priority is therefore determined in each dot only by the processing of an item of shape data (information as to whether or not the dot is transparent) of 1 bit. As a result, the structure of the priority decision circuit used for the processing is greatly simplified and the arithmetic processing time required for determining the priority is greatly shortened.

Thus, the image display apparatus according to the present invention is capable of executing the arithmetic processing for synthesizing and outputting one color picture with a much simpler structure and a higher speed than the conventional apparatus and, in addition, it is possible to manufacture the apparatus itself at a lower cost.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 8:
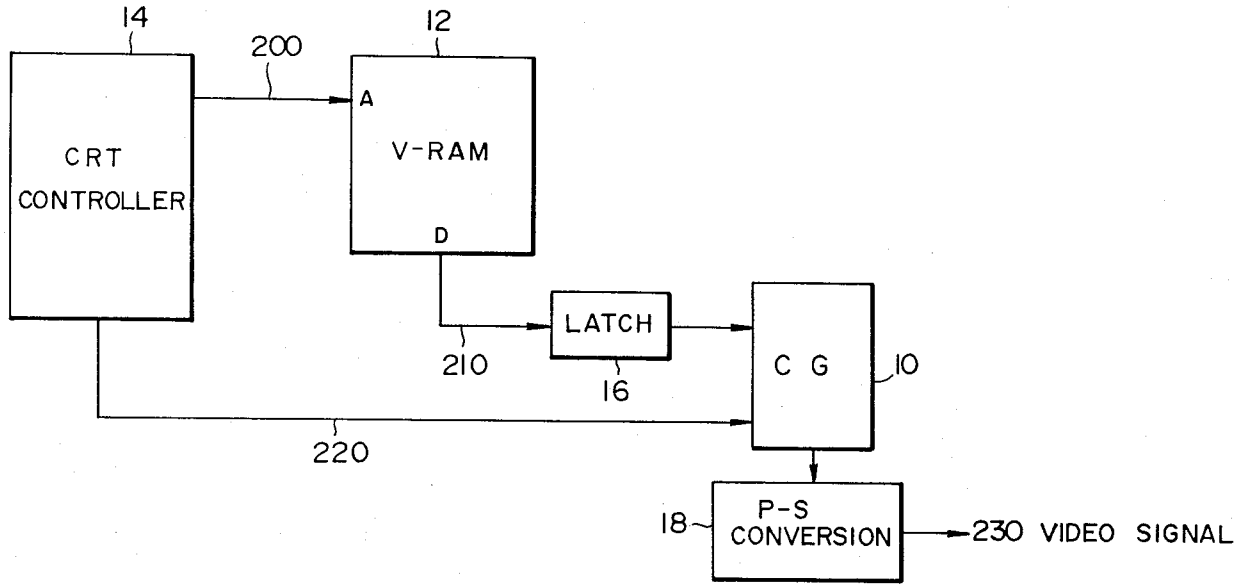
FIG. 8 PRIOR ART
FIG. 8 is a block diagram of the fundamental structure of the circuitry of a conventional character block system.
Figure 9:
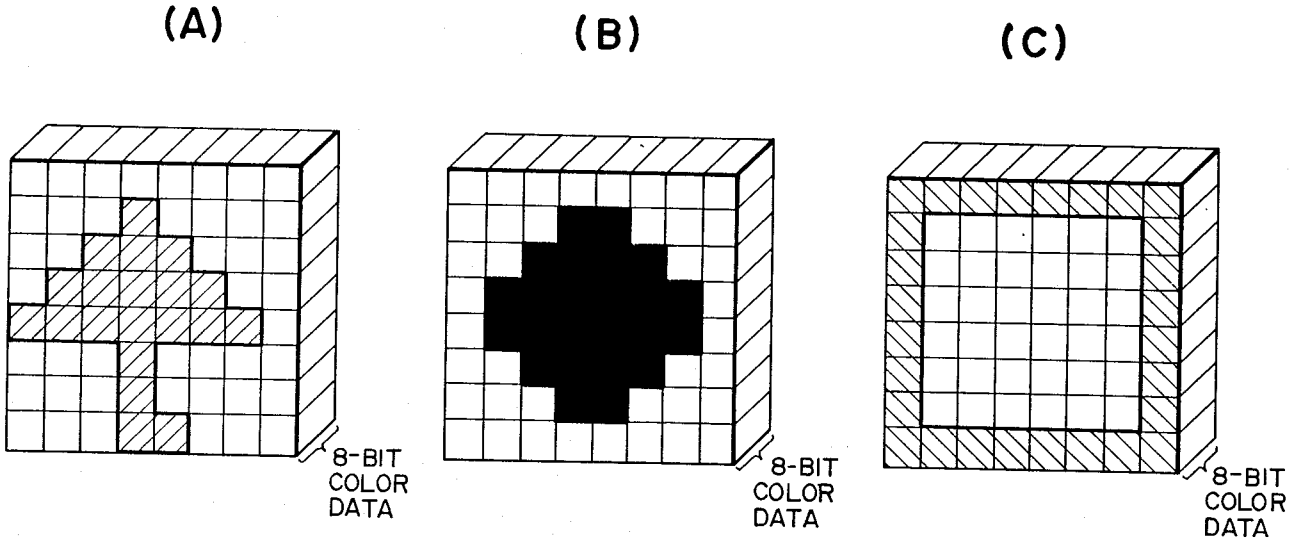
FIGS. 9A, 9B and 9C are an explanatory view of the examples of color character data displayed in the corresponding character blocks.
Figure 10:
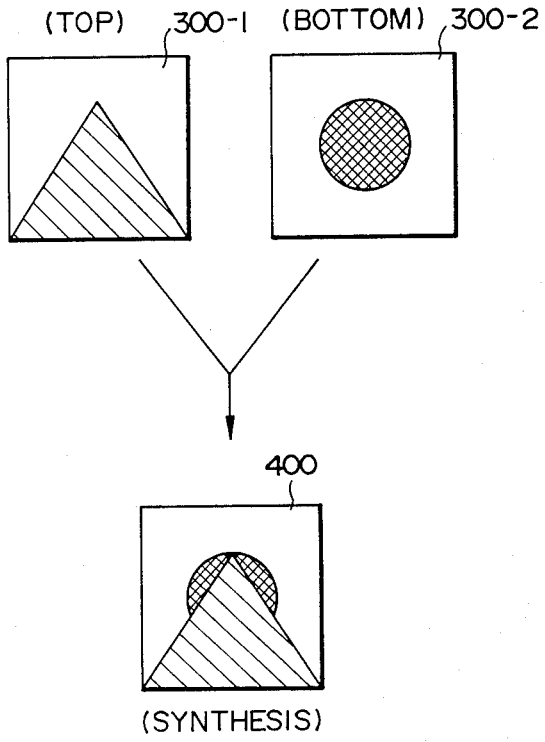
FIG. 10 is an explanatory view of a plurality of pictures displayed in an overlapping state.
Figures 11, 11A:
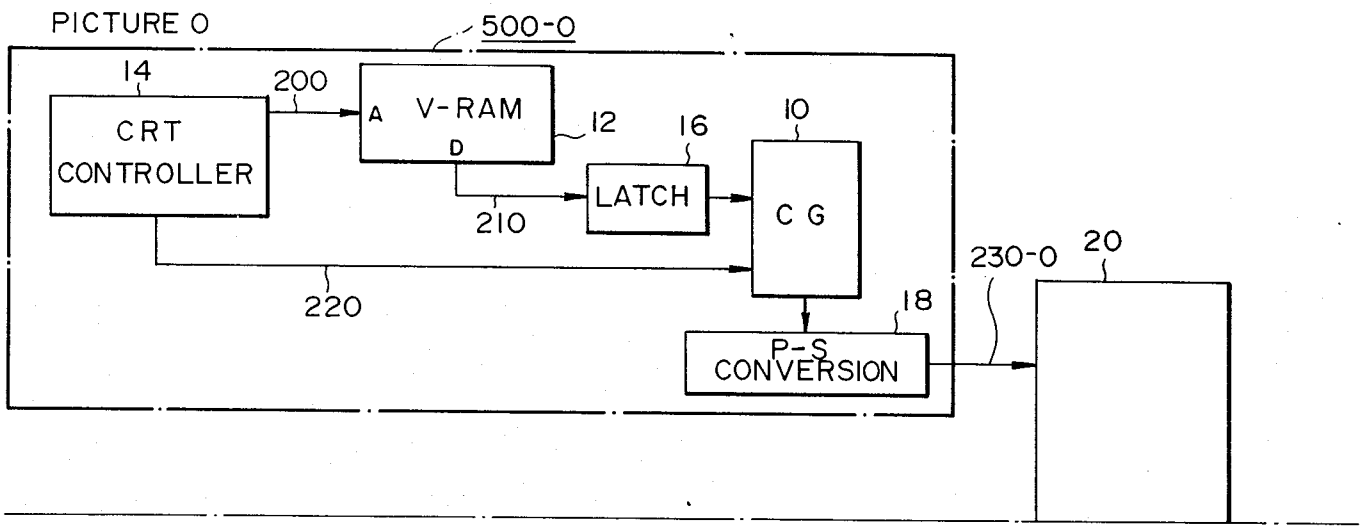
FIG. 11 PRIOR ART
FIGS. 11, 11A and 11B are a block diagram of a conventional apparatus used for synthesizing a picture from a plurality of overlapping pictures.
Figure 11B:
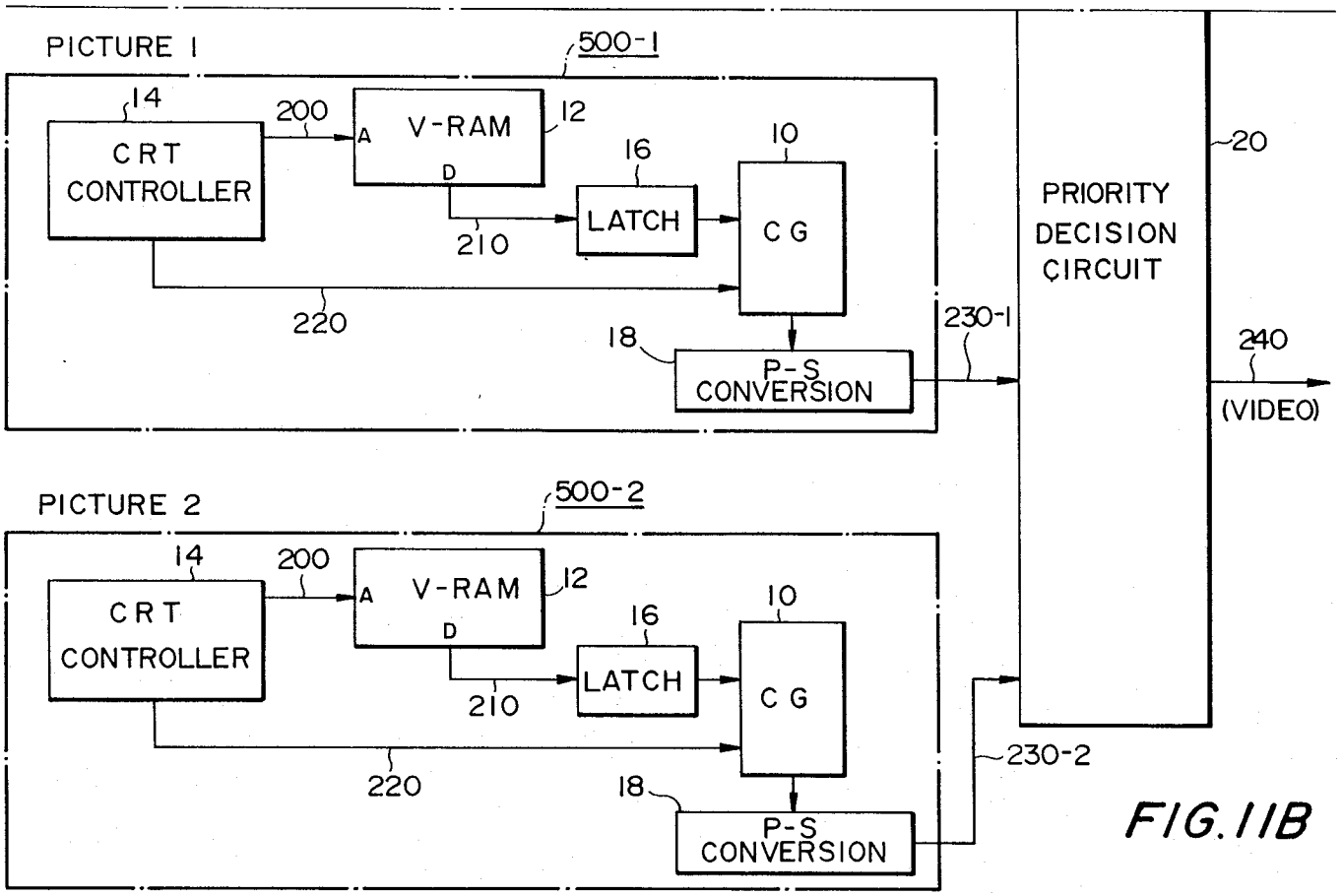
Figure 12:
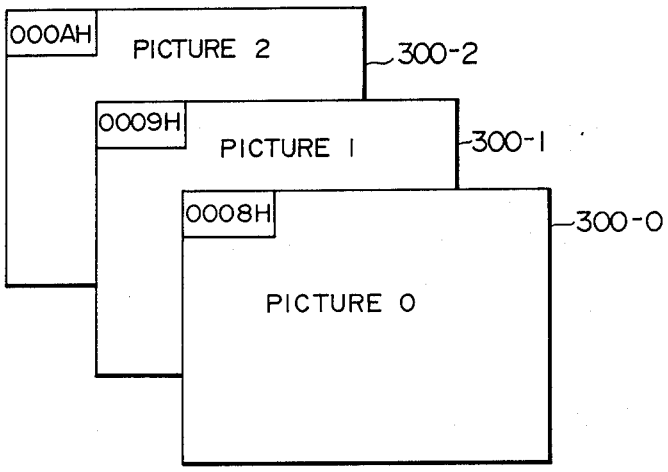
FIG. 12 is an explanatory view of three pictures formed for overlapping display.
Figure 13:
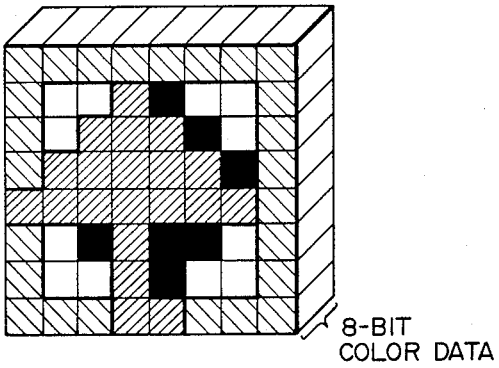
FIG. 13 is a character synthesized from the character data shown in FIGS. 9(A) to 9(C).

A preferred embodiment of the present invention will be explained hereinunder with reference to the accompanying drawings. The same numerals are provided for the elements which correspond to those in the conventional apparatus shown in FIG. 8, and explanation thereof will be omitted.

Figures 1, 1A:
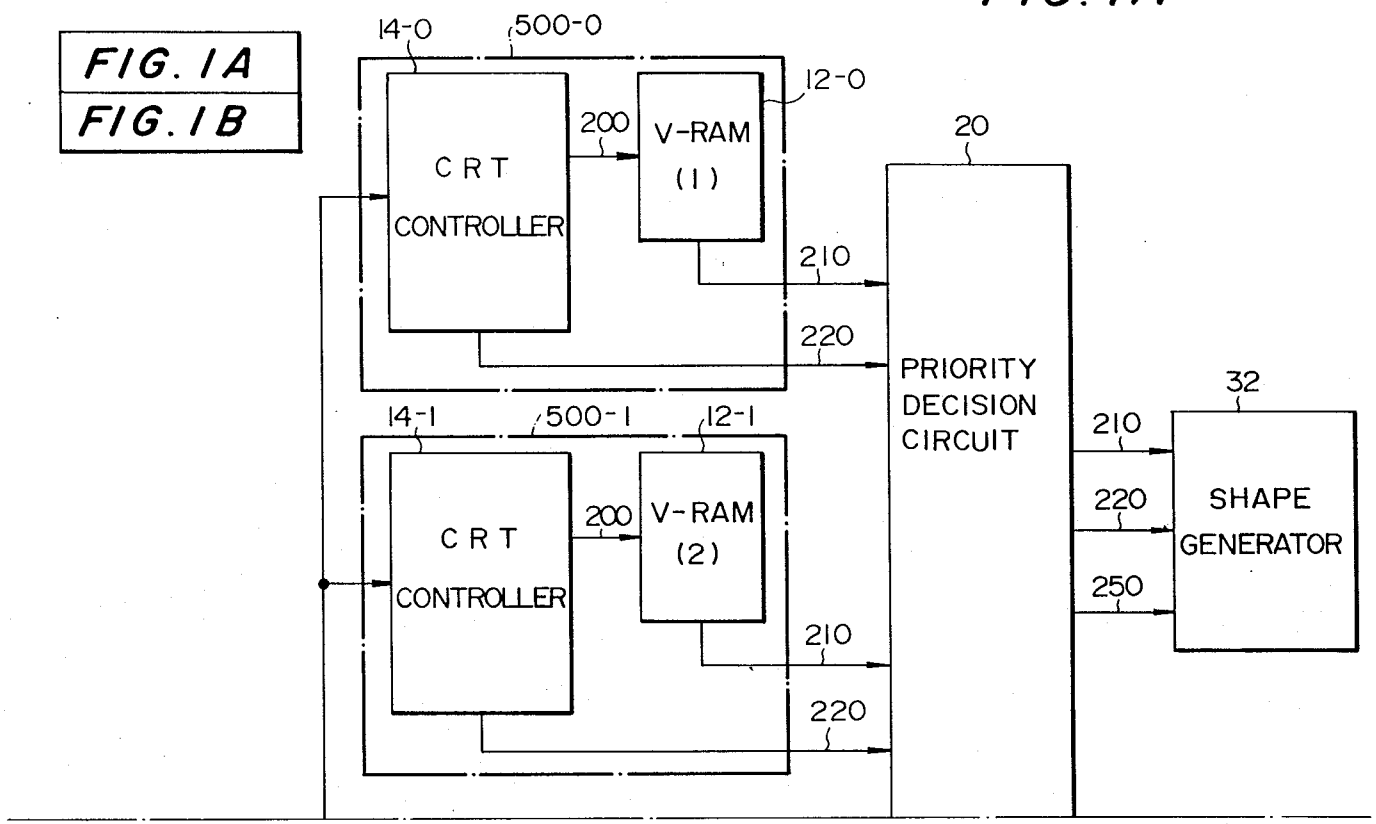
FIGS. 1A and 1B are a block diagram of a preferred embodiment of an image display apparatus according to the present invention.
Figure 1B:
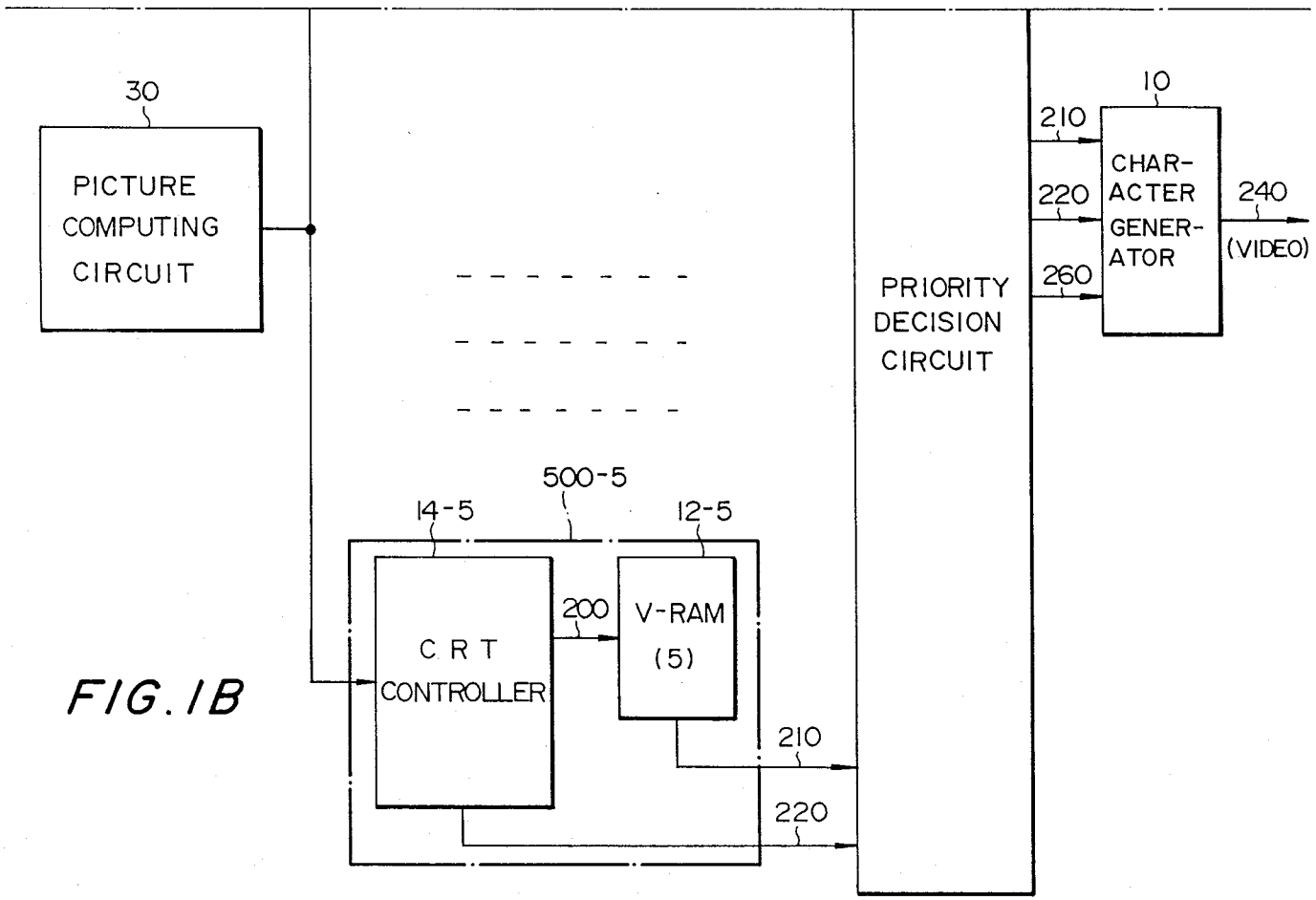
Figure 2:
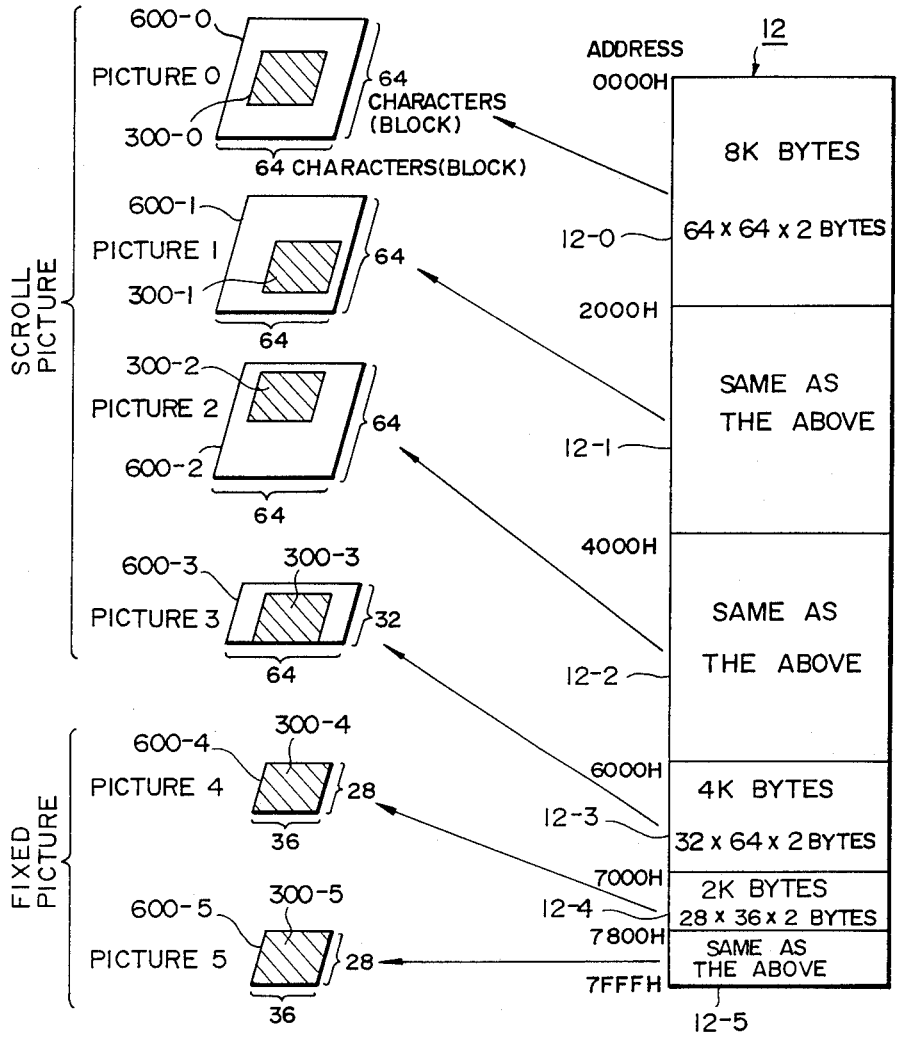
FIG. 2 is an explanatory view of the relationship between the images of the pictures displayed in an overlapping state and the video RAM in which data of the respective pictures are registered.

FIG. 1 shows a preferred embodiment of an image display apparatus according to the present invention. The apparatus of this embodiment includes six picture formation circuits 500-0, 500-1, . . . 500-5. Each picture formation circuit 500 is composed of a CRT controller 14 and a video RAM 12 serving as a picture display memory. FIG. 2 shows the relationship between the image in each picture formed by using each of the picture formation circuits 500-0, 500-1, 500-5 and the video RAM 12.

The video RAMs 12-0, 12-1, . . . 12-5 provided in the picture formation circuits 500-0, 500-1, . . . 500-5, respectively, are composed of six divisions of the storage region of the video RAM 12 which is divided by predetermined addresses, as shown in FIG. 2.

In this embodiment, the video RAMs 12-0, 12-1 and 12-2 are used for forming scroll reference pictures 600-0, 600-1 and 600-2, respectively, each having 64 character blocks in the vertical direction and 64 character blocks in the horizontal direction. A character read address 210 necessary for reading color character data which are to be displayed in the respective scroll reference pictures from a character generator 10 is registered in each of the video RAMs 12-0, 12-1 and 12-2.

In the video RAM 12-3, the data on a scroll reference picture 600-3 having a rectangular configuration of 32 character blocks in the vertical direction and 64 character blocks in the horizontal direction are registered in the same way.

In the video RAMs 12-4 and 12-5 the data on fixed pictures 600-4 and 600-5, respectively, each having a rectangular configuration of 28 character blocks×36 character blocks are registered in the same way.

As shown in FIG. 2, the data on the scroll reference pictures 600-0, 600-1, . . . 600-3 are registered in the respective video RAMs 12-0, . . . 12-3 of the respective picture formation circuits 500-0 to 500-3. It is therefore necessary to designate the pictures 300-0, 300-1, . . . 300-3 to be displayed on the CRT from the respective scroll reference pictures.

In contrast, in the video RAMs 12-4 and 12-5 of the picture formation circuits 500-4 and 500-5, respectively, the fixed pictures 600-4 and 600-5 are registered, as described above, which are displayed as they are on the CRT as the CRT display pictures 300-4 and 300-5.

The apparatus of this embodiment is therefore provided with a picture computing circuit 30 for designating the CRT display pictures 300-0, 300-1, . . . 300-3 from the scroll reference pictures 600-0, 600-1, . . . 600-3, respectively, and the designation signals are output from the picture computing circuit 30 to the CRT controllers 14 of the respective picture formation circuits.

The character read address signal 210 and a vertical scanning position address signals 220 of the corresponding character block which are necessary for forming the CRT display pictures 300-0, 300-1, . . . 300-3 are output from each of the picture formation circuits 500-0, 500-1, . . . 500-3, respectively, to a priority decision circuit 20.

The first characteristic feature of the present invention is that the image display apparatus is provided with a shape generator 32 in which plural items of character shape data which are displayed in the corresponding character blocks are registered in advance.

The shape generator 32 outputs character shape data 250 for one horizontal scan of the character block which is designated by the vertical scanning position address signal 220 (shape data for a horizontal scan of 8 dots) in accordance with the character shape data which are designated by the character read address signal 210 every time the address signal 210 and the vertical scanning position address signal 220 are output from each of the picture formation circuits 500-0, 500-1, . . . 500-5.

It is impossible to read the character shape data 250 of the pictures 300-0, 300-1, 300-5 simultaneously from the one shape generator 32. For this reason, in this embodiment, the technique of time sharing is adopted for successively reading the data 250 of the pictures 300-0 to 300-5.

The priority decision circuit 20 compares the character shape data 250 of the respective pictures which are output from the shape generator 32 in this way with each other in each dot in accordance with predetermined priorities. During the horizontal scan of each character block of the CRT, the priority picture to be displayed on the CRT is determined in each dot.

The character shape data 250 for one horizontal scan which is compare with another character shape data 250 is information as to whether or not the corresponding dot is transparent, so that data of 1 bit is sufficient for one dot.

Therefore, the necessary amount of character shape data 250 for one horizontal scan which is output from the shape generator 32 is $\frac{1}{8}$ the amount of color character data for one horizontal scan which is output from the character generator 10 in the same way. It is therefore possible to greatly shorten the arithmetic processing time required for determining the priority picture by comparing plural items of character shape data output from the shape generator 32, as described above. In addition, since the amount of data to be processed is small, it is possible to simplify the structure of the priority decision circuit to a large extent.

The second characteristic feature of the present invention is that the utilization of the results of the priority decision circuit enables the one character generator 10 to synthesize one color picture by placing a plurality of pictures with one on top of another.

Whenever the priority decision circuit 20 determines the priority picture which is to be displayed on the CRT for each dot, the priority decision circuit 20 inputs the character read address signal 210, the vertical scanning position address signal 220 and the horizontal scanning position address signal 260 for the character generator block which are output from the picture formation circuit 500 in the character generator 10 in correspondence with the priority picture.

The character generator read address signal 210 informs the character generator 10 of the designated color character data. The character generator 10 then outputs color data for one dot which are specified by the vertical scanning position (vertical scanning position address signal 220) and the horizontal scanning position (horizontal scanning position address signal 260) as the video signal 240 for picture synthesis.

In this way, according to the present invention, the one character generator 10 successively outputs the color data for the dot which indicates the scanning position as the video signal 240 in synchronization with the horizontal scanning and the vertical scanning of the CRT, thereby synthesizing one color picture.

According to the present invention, the one character generator 10 is sufficient even if the number of the overlapping pictures is increased, so that the effect of reducing the cost in comparison with a conventional apparatus is heightened as the number of the overlapping pictures is increased.

Since the only one character generator 10 is used according to the present invention, it is possible to register the color character data which are to be displayed in the corresponding character blocks of the pictures 600-0, 600-1, . . . 600-5 without overlapping as in a conventional apparatus and, hence, to utilize the memory space in the character generator with efficiency.

Since the only one character generator 10 is used according to the present invention, the space in the interior of the apparatus which is occupied by the character generator 10 is small, thereby enabling comparatively free and efficient arrangement of circuitry in the limited space.

Figures 3, 3A:
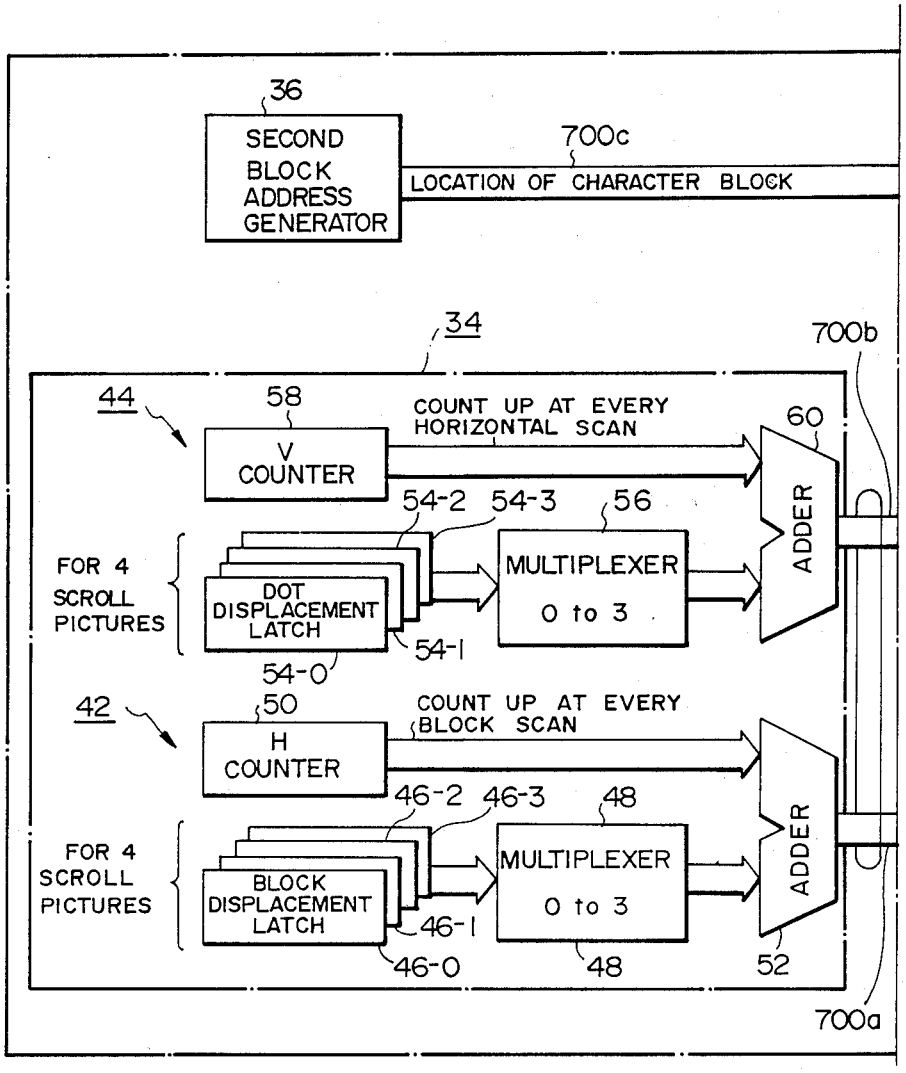
FIGS. 3, 3A, 3B and 4, 4A, 4B are block diagrams of another embodiment of the present invention.
Figure 3B:
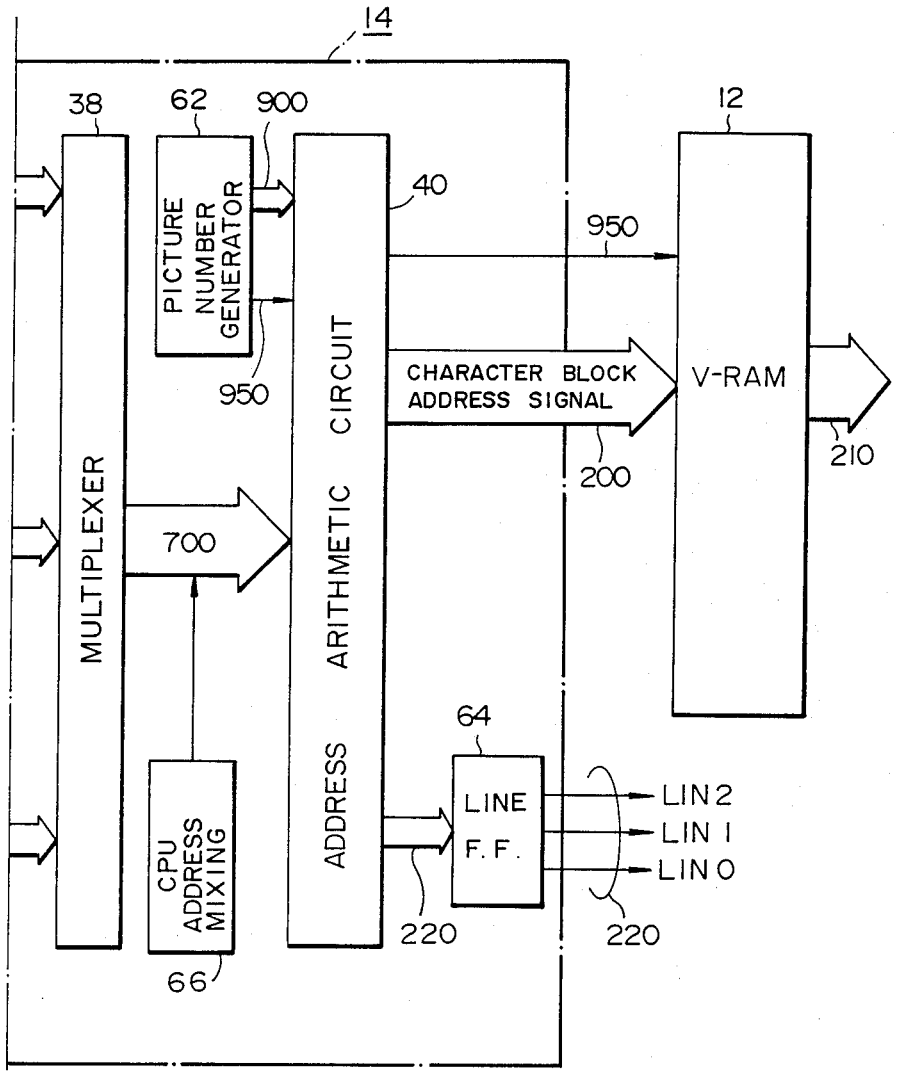
Figures 4, 4A:
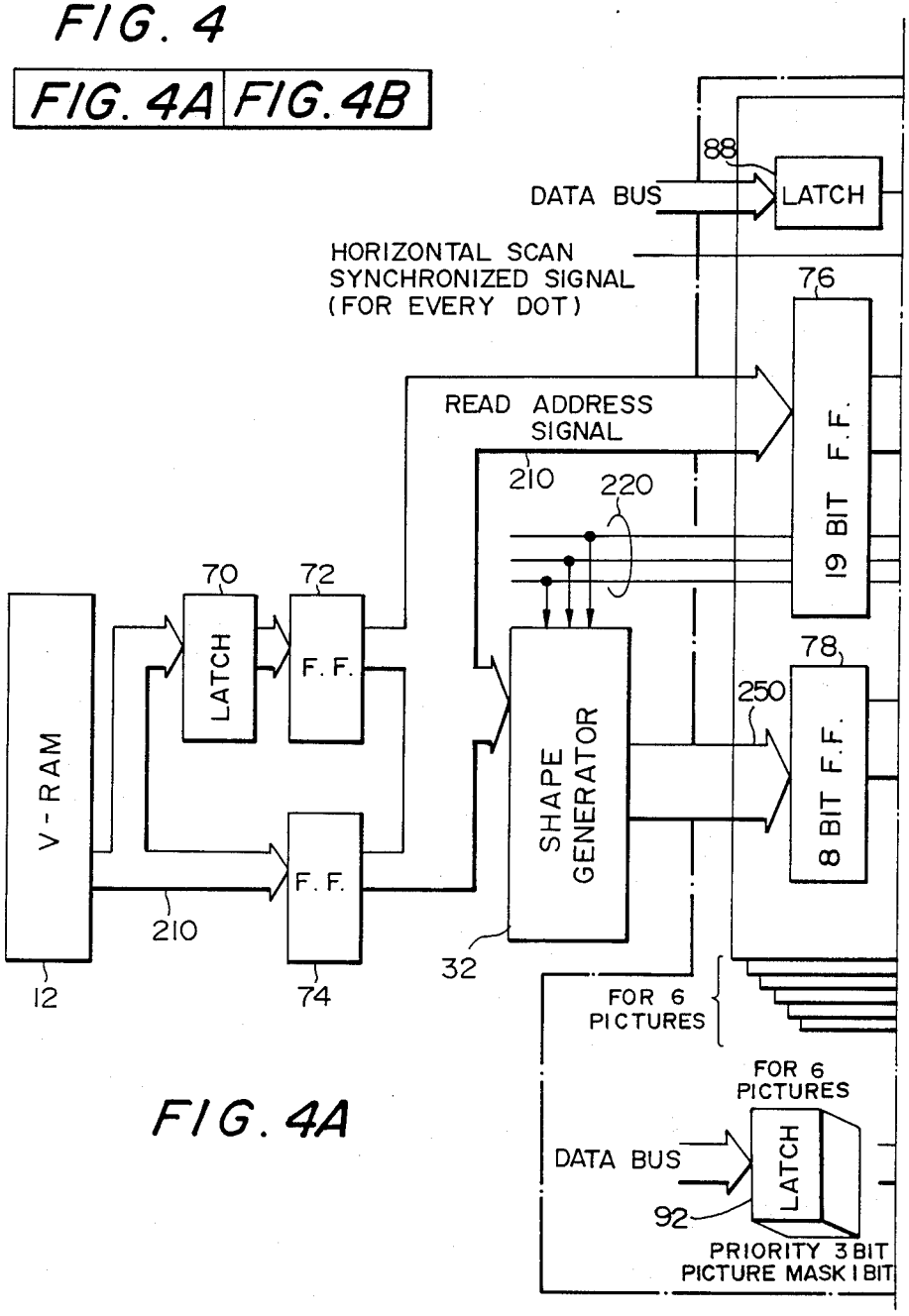
Figure 4B:
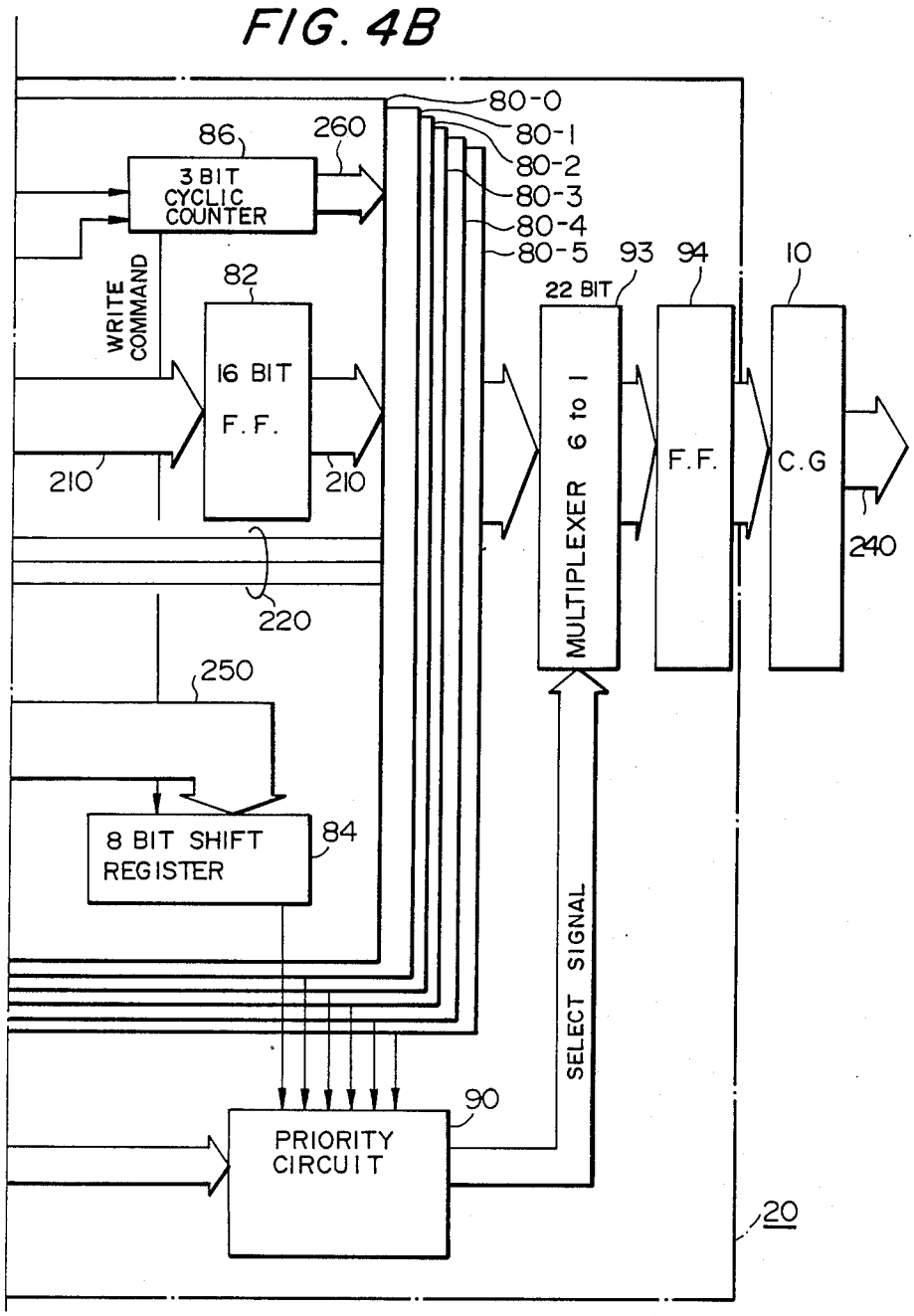

FIGS. 3 and 4 show the structure of the circuitry of another embodiment of an image display apparatus according to the present invention.

(a) Picture formation circuit

FIG. 3 shows the structure of the picture formation circuit 500 used in this embodiment. This embodiment is characterized in that the plurality of picture formation circuits 500-0, 500-1, . . . 500-5 shown in FIG. 1 are formed as one picture formation circuit 500 by using the technique of time sharing.

For example, in order to synthesize one color picture by placing six pictures with one on top of another, as shown in FIG. 2, the picture formation circuit 500 is so composed as to output the character read address signals 210 and the vertical scanning position address signals 220 of the respective pictures 600-0, 600-1, . . . 600-5 in that order in synchronization with the horizontal and vertical scans of the CRT.

For this purpose, the picture formation circuit 500 in this embodiment is composed of the one CRT controller 14 and the video RAM 12 serving as the picture display memory.

(a-1) Video RAM

The memory region of the video RAM 12 is divided into six regions by predetermined addresses, as shown in FIG. 2. In each of the divided regions, as shown in FIG. 2, the character read address of the corresponding scroll reference picture 600-0, 600-1, . . . or 600-3 or the corresponding fixed picture 600-4 or 600-5 is registered in the same way as in the video RAMs 12-0, 12-1, . . . 12-5 shown in FIG. 1.

In this embodiment, the character read address 210 is composed of data of 2 bytes, and each byte of data is registered in the two consecutive character block addresses in the video RAM 12.

(a-2) CRT controller

In this embodiment, the CRT controller 14 includes a first block address generation circuit 34 and a second block address generation circuit 36 and selectively outputs the signals output from these block address generation circuits 34 and 36 to an address computing circuit 40 through a multiplexer 38.

The first block address generation circuit 34 generates block addresses for the scroll reference pictures 600-0, 600-1, . . . 600-3 shown in FIG. 2. The second block address generation circuit 36 generates block addresses for the fixed pictures 600-4 and 600-5.

The first block address generation circuit 34 in this embodiment is composed of a horizontal block computing circuit 42 for outputting a signal **700*a* which indicates the block position in the horizontal direction of the corresponding scroll reference picture 600-0, 600-1, . . . or 600-3, and a vertical position computing circuit 44 for outputting a signal 700*b* which indicates the vertical position of the scanning line in the corresponding scroll reference picture 600-0, 600-1, . . . or 600-3**.

The horizontal block computing circuit 42 is composed of four block displacement latch circuits 46-0, 46-1, 46-2 and 46-3 which correspond to the respective scroll reference pictures, a multiplexer 48 for selectively switching and outputting the output of each latch circuit 46 at a predetermined timing, an H counter 50 for increasing the count value by one at the end of every horizontal scan of one block of the CRT and an adder 52 for adding the output of the H counter 50 and the output of the multiplexer 48 and outputting the signal **700*a*** which indicates the block position in the horizontal direction of the corresponding scroll reference picture.

The vertical position computing circuit 44 is composed of four latch circuits 54-0, 54-1, 54-2 and 54-3 for setting the dot displacements relative to the vertical direction of the scroll reference pictures 600-0, 600-1, . . . 600-3, respectively, a multiplexer 56 for selectively outputting the output of each latch circuit 54 at a predetermined timing, a V counter for increasing the count value by one at the end of every horizontal scan of the picture to be displayed in the CRT and an adder 60 for adding the output of the V counter 58 and the output of the multiplexer 56 and outputting the signal **700*b* which indicates the vertical position of the scanning line in the scroll reference picture 600**.

Figure 5:
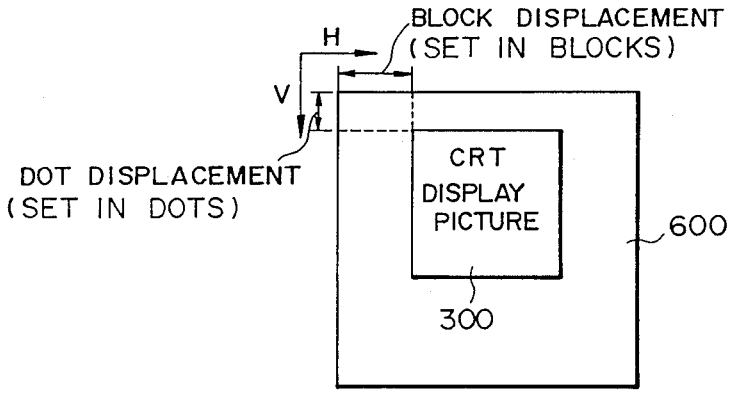
FIG. 5 is an explanatory view of the block displacement of the CRT display picture in a scroll reference picture.
Figure 7:
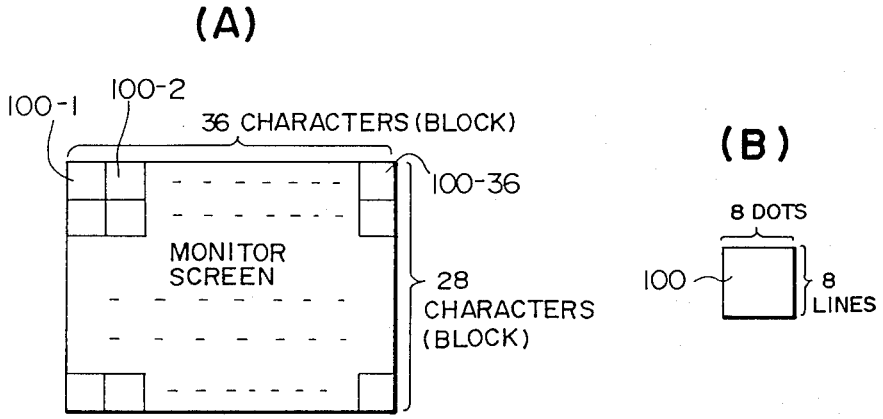
FIGS. 7A and 7B are an explanatory view of the principle of displaying a picture on a CRT by a character block system.

More specifically, it is necessary to point out to which extent the left upper corner of the CRT display picture 300 is displaced relative to the left upper corner of the scroll reference picture 600 in order to specify the CRT display picture 300 by scrolling the scroll reference picture 600, as shown in FIG. 5.

To this end, in the horizontal block computing circuit 42 in this embodiment the displacements relative to the horizontal direction of the CRT display pictures 300-0, 300-1, . . . 300-3, respectively, are set in blocks, and the displacements in blocks in this way are set in the displacement latch circuits 46-0, 46-1, . . . 46-3, respectively, which correspond to the respective pictures.

In the vertical block computing circuit 44 in this embodiment the displacements relative to the vertical direction of the CRT display pictures 300-0, 300-1, . . . 300-3, respectively, are set in dots, and the displacements set in dots in this way are set in the displacement latch circuits 54-0, 54-1, . . . 54-3, respectively, which correspond to the respective pictures.

Therefore, if the multiplexers 48 and 56 are operated in combination with each other in order to so control the displacements of the CRT display pictures 300-0 to 300-3 as to selectively output at a predetermined timing, the adders 52 and 60 successively output the signals **700*a* which indicate the block positions in the horizontal direction of the scroll reference pictures 600-0, 600-1, . . . 600-3 and the signals 700*b* which indicate the vertical positions of the scanning lines in correspondence with the scroll reference pictures 600-0, 600-1, . . . 600-3** in that order.

The second block generation circuit 36 outputs a signal **700*c* which indicates the position of the character block itself of the corresponding fixed picture 600-4 or 600-5 shown in FIG. 2**.

The multiplexer 38 outputs the pairs of signals **700*a* and 700*b* to the address computing circuit 40 which are successively output from the first block address generation circuit 34 in correspondence with the scroll reference pictures 600-0, 600-1, 600-2 and 600-3 in that order. The multiplexer 38 thereafter outputs the signals 700c to the address computing circuit 40 which are output from the second block address generation circuit 36 in correspondence with the fixed pictures 600-4 and 600-5** in that order.

In other words, the signals 700 are successively input in the address computing circuit 40 in correspondence with the pictures 600-0, 600-1, . . . 600-5 in that order.

The CRT controller 14 in this embodiment is provided with a picture number generation circuit 62 for outputting the identification number 900 (identification number of the memory space in the video RAM 12) of the picture which corresponds to the signal 700 which is selectively output from the multiplexer 38.

The picture number generation circuit 62 also outputs a signal 950 which designates the upper 1 byte and the lower 1 byte of the character read address signal 210 for the character to be displayed in the picture identified by the picture number generation circuit 62.

Therefore, in the address computing circuit 40 are input the picture identification numbers 900 which are successively output from the picture number generation circuit 62 in correspondence with the pictures 600-0, 600-1, . . . 600-5 in that order, the signal 950 for designating the upper 1 byte and the lower 1 byte of each character read address signal 210, and the signal 700 which is output through the multiplexer 38 in correspondence with the signal 950.

On the basis of the signals input in this way and in synchronization with the horizontal and vertical scans of the CRT, the address computing circuit 40 successively computes the character block address signals 200 for designating the respective character blocks 100, the signals 950 for designating the upper 1 byte and the lower 1 byte of the character read addresses which are registered in the corresponding character blocks and outputs these signals (the signal obtained by combining the signals 200 and 950 constitutes the read address of the video RAM 12) to the video RAM 12 in correspondence with the CRT display pictures 300-0, 300-1, . . . 300-5 in that order. The address computing circuit 40 also computes the vertical scanning position address signal 220 in each character block 100, and outputs the result as information of 3 bits through a line flip flop 64.

Therefore, the video RAM 12 outputs the read address signals 210 for the characters which are to be displayed in the corresponding character blocks on the basis of the input character block address signals 200 in correspondence with the CRT display pictures 300-0, 300-1, . . . 300-5 in that order. Simultaneously, the line flip flop 64 outputs the vertical scanning position address signal 220 corresponding to the read address signal 210 which is being output.

The CRT controller 14 in this embodiment is also provided with a CPU address mixing circuit 66, which sets and registers a new character read address signal 210, if necessary, in a predetermined address under the instruction of the CPU by utilizing the spare time of the multiplexer 38 and the address computing circuit 40.

The character read address signal 210 registered in the video RAM 12 is composed of data of 2 bytes, as described above. Accordingly, when the character block address signal 200 is output from the address computing circuit 40 together with the signal 950 from the picture number generation circuit 62, the video RAM 12 outputs the corresponding read address signal 210 twice, 1 byte at each time.

The read address signal 210 of 1 byte output first from the video RAM 12 is therefore temporarily latched in a latch circuit 70, as shown in FIG. 4. At the same time with the output of the read address signal of the second 1 byte, the first read address signal 210 latched in the latch circuit 70 is output to a flip flop 72, while the second read address signal 210 is output to a flip flop 74.

(b) Shape generator

The read address signal 210 of 2 bytes which are respectively set in the flip flops 72 and 74 in this way is output to a 19-bit flip flop 76 which constitutes a part of the shape generator 32 and the priority decision circuit 20.

At the same time, the flip flop 64 outputs the vertical scanning position address signal 220 of 3 bits which correspond to the read address signal 210 to the shape generator 32 and the 19-bit flip flop 76.

As described above, in the shape generator 32, the read address signal 220 and the corresponding vertical scanning position address signal 210 are input. As a result, the character shape data 250 for one horizontal scan of the character block which is designated by the vertical scanning position address signal 220 from among the character shape data which are designated by the character read address signal 210 are output from the shape generator 32 to an 8-bit flip flop 78 in the priority decision circuit 20.

(c) Priority decision circuit

In this embodiment, the priority decision circuit 20 is provided with six picture data storage circuits 80-0, 80-1, . . . 80-5 which correspond to the six CRT display pictures 300-0, 300-1, . . . 300-5, respectively, which are shown in FIG. 2. The picture data storage circuit 80 is selected in correspondence with picture 300 containing the character read address signal 210 which is being output from the flip flops 72 and 74.

In the thus-selected picture data storage circuit 80 are input the character read address signals 210 output from the flip flops 72 and 74, the vertical scanning position address signal 220 output from the line flip flop 64 and the character shape data 250 for one horizontal scan output from the shape generator 32.

In this embodiment, each picture data storage circuit 80 is composed of the 19-bit flip flop 76, the 8-bit flip flop 78, a 16-bit flip flop 82, an 8-bit shift register 84, a 3-bit cyclic counter 86 and a latch circuit 88 for setting the displacement in the horizontal direction.

When the character read address signal 210 for the corresponding picture is output from the pair of flip flops 72 and 74, the read address signal 210 and the vertical scanning position address signal 220 are input in the 19-bit flip flop 76, as described above. In the 16-bit flip flop 82, only the character read address signal 210 is input from the 19-bit flip flop 76.

In the 8-bit flip flop 78, the character shape data 250 for one horizontal scan of the character block of the corresponding picture is input, as described above. The 3-bit cyclic counter 86 outputs the command of writing the data 250 in the 8-bit flip flop 78 to the 8-bit shift register 84 every time the count value becomes 0.

The displacement in the horizontal direction is written into the latch circuit 88 from the outside through a data bus, and the 3-bit cyclic counter 86 cyclically counts the horizontal scanning synchronized signals by adding one with the displacement written in the latch circuit as the initial value every time the horizontal scanning synchronized signal for one dot is output.

Figure 6:
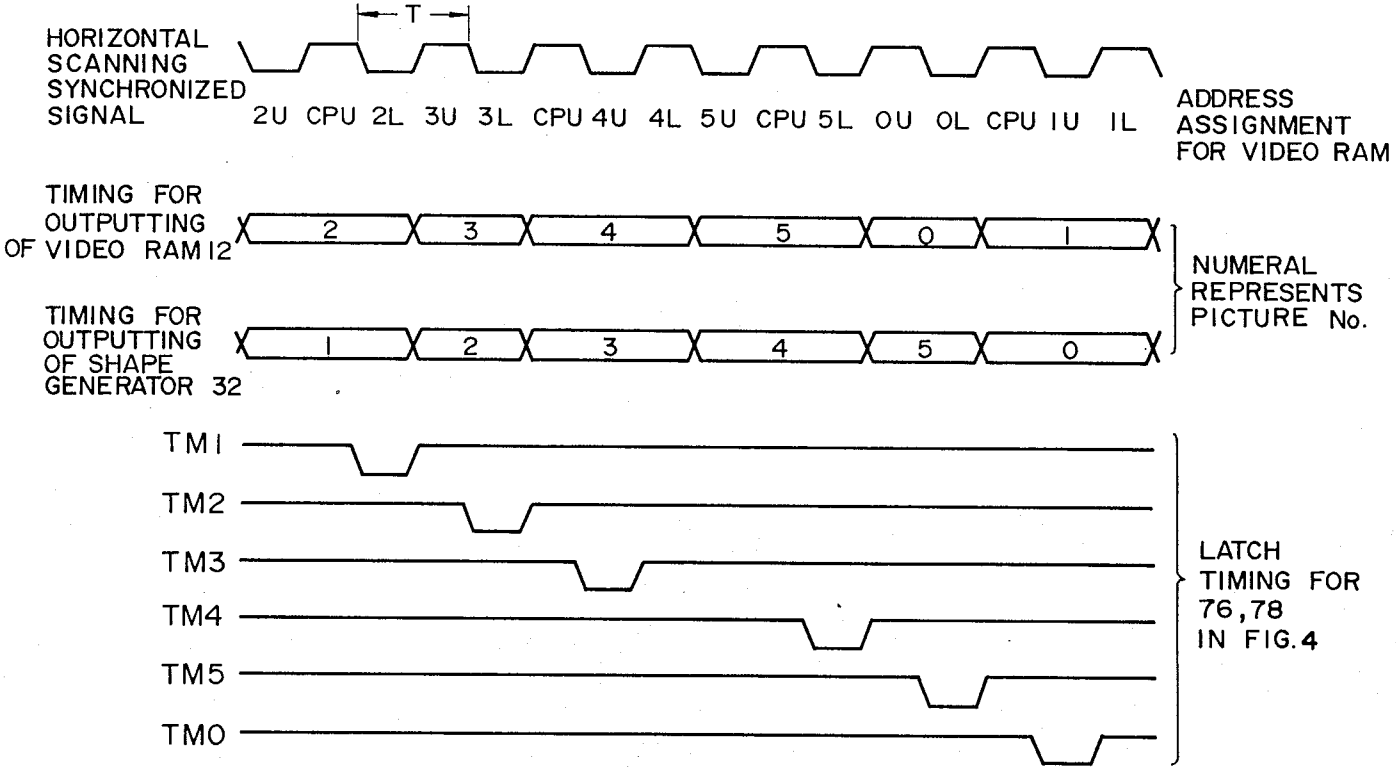
FIG. 6 is a timing chart of the embodiment shown in FIGS. 3 and 4.

The initial values of the respective counters 86 are set at the timings of TM1 to TM0 corresponding to the respective pictures, which are shown in FIG. 6 and will be described later.

For example, if the displacement of "2" is set in the latch circuit 88, the 3-bit cyclic counter 86 counts cyclically in the order of 2→3→4→5→6→7→8→0→1 in synchronization with a horizontal scan of the CRT, and every time the count value becomes 0, the above-described write command is output to the shift register 84.

FIG. 6 shows the timing chart of this embodiment. In the apparatus of this embodiment, a clock pulse of 6 MHz is used as the horizontal scanning synchronized signal for executing a horizontal scan of the CRT.

Therefore, in the apparatus of this embodiment, one dot of the CRT is scanned for the time T which corresponds to one period of the synchronized signal. The timing chart shown in FIG. 6 shows the operation of the apparatus in the case of scanning 8 dots of the CRT.

In the apparatus of this embodiment, the CRT controller 14 outputs the character block address signal 200 of the corresponding CRT display picture 300 and the character read address signal 210 of the corresponding picture 300 is read from the video RAM 12 every time the synchronized signal is turned on or off. In the timing chart shown in FIG. 6, the character read address signals 210 are read from the video RAM 12 in correspondence with the CRT display pictures 300-2, 300-3, 300-4, 300-5, 300-0, 300-1 in that order.

Immediately after the character read address signal 210 of the picture is read from the video RAM 12, the character shape data 250 for one horizontal scan of the corresponding picture is output from the shape generator and is output to the 8-bit flip flop 78 of the corresponding picture data storage circuit 80.

In the apparatus of this embodiment, the character shape data output from the shape generator 32 are input in the respective 8-bit flip flops 78 of the picture data storage circuits 80-1, 80-2, . . . 80-0 at the timings of TM1, TM2, . . . TM0, respectively, as shown in FIG. 6.

There is a time lag of a predetermined number of pulses among the reading timings TM1, TM2, . . . TM0. Therefore, the number of pulses corresponding to the time lag is registered in advance in the respective latch circuits 88 of the picture data storage circuits 80-1, 80-2, . . . 80-0, respectively, so that the count value of the 3-bit cyclic counter 86 of every picture data storage circuit 80 simultaneously becomes 0 and the data write command is simultaneously output to the 8-bit shift register of every picture data storage circuit 80.

The character shape data 250 for one horizontal scan of the character blocks which are written into the respective 8-bit shift registers of the picture data storage circuits 80-0, 80-1, . . . 80-5, namely, data of 8 bits are output to the priority circuit 90.

The priority decision circuit 20 of this embodiment is provided with a latch circuit 92 in which the priorities of the six pictures are registered. In each data write region of the latch circuit 92 which corresponds to each picture, the priority of the picture 300-0, 300-1, . . . or 300-5 is registered as data of 3 bits under the instruction of the CPU, and further picture mask information showing whether the corresponding picture is transparent or not is registered a data of 1 bit.

The priority circuit 90 compares the character shape data 250 output from the 8-bit shift register 84 of the picture data storage circuit 80 with another character shape data in each dot on the basis of the priorities of the respective pictures which are set and registered in the latch circuit 92 so as to determine the picture having the highest priority for each dot, and outputs a selection signal commanding the selection of the priority picture (the selection of the picture data storage circuit which corresponds to the picture having the highest priority) to a multiplexer 93.

In the case where the priorities of the six pictures vary, it is preferable to set the priorities of the pictures in the latch circuit 92 whenever the priorities vary, but if the priorities of the pictures are fixed and do not change, it is possible to use the priority circuit 92 in which the priorities are set in advance.

Every time one dot of the CRT is scanned, the multiplexer 93 outputs (1) the horizontal scanning position address signal 260 in one character block which is output from the 3-bit cyclic counter 86, (2) the vertical scanning position address signal 220 in one character block which is output from the 19-bit flip flop 76 and (3) the character read address signal 210 which is output from the 16-bit flip flop 82 to the character generator 10 through a flip flop 94.

The color character data are therefore specified in the character generator 10 by the character read address signal 210. The color data of 8 bits for one dot which is specified by the vertical scanning position address signal 220 and the horizontal scanning position address signal 260 in the corresponding character block are output from the character generator 10 as the video signal 240 for the picture being synthesized.

In this way, according to the present invention, the color data of the respective dots which indicate the scanning positions are successively output as the video signals 240 from the character generator 10 in synchronization with horizontal and vertical scans of the CRT, thereby enabling one picture to be synthesized.

Although one character block 100 is set at 8×8 dots in this embodiment, but the present invention is not restricted thereto and one character block 100 may be set at a given size as occasion demands.

The displacement in the horizontal direction of the display picture 300 with respect to the scroll reference picture 600 is set in blocks in this embodiment, as shown in FIG. 5, but the apparatus of this embodiment also enables the displacement relative to the horizontal direction of the display picture 300 to be set in dots in the same way as in the vertical direction if the value which corresponds to the dot displacement is set relative to the other pictures in the latch circuit 88.

It is also possible to set the displacement in the horizontal direction in dots by using, e.g., 9-bit information. In this case, the lower 3 bits are input in the latch circuit 88 and the upper 6 bits are input in the block displacement latch circuit 46 as block unit information.

Although a CRT is used in this embodiment, it goes without saying that the present invention is not restricted thereto and is effective to various raster displays other than the CRT.

As described above, according to the present invention, since only one character generator is used for synthesizing one color picture by placing a plurality of pictures with one on top of another, it is possible to reduce in the cost of the apparatus as a whole.

According to the present invention, it is possible to utilize the memory space in the character generator with efficiency without producing a problem of overlapping registration of the same color character data in a plurality of character generators unlike a conventional apparatus.

Since only one character generator is used according to the present invention, the space of the interior of the apparatus which is occupied by the character generator is small. Particularly, when a multiplicity of pictures are placed with one on top of another for synthesizing one color picture, the space of the apparatus which is occupied by the character generator is much smaller than in a conventional apparatus, thereby enabling efficient arrangement of circuitry.

Furthermore, according to the present invention, it is possible to determine the priority of each picture by using a shape generator, thereby greatly simplifying the structure of a priority decision circuit and, in addition, greatly shortening the arithmetic processing time required for determining the priority.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An image display apparatus which synthesizes one color picture by placing a plurality of pictures with one on top of another, said image display apparatus comprising:

a picture display memory for dividing each of said pictures before synthesis into a plurality of character blocks, and registering addresses for reading the color characters to be displayed in the respective character blocks at the respective character block addresses;

a raster display controller for successively outputting the character block address signals of the respective pictures before synthesis to said picture display memory in synchronization with horizontal and vertical scans of a raster display so that said picture display memory successively outputs the corresponding character read address signals in the numerical order of said pictures, and for successively outputting vertical scanning position address signals for the corresponding character blocks of the respective pictures;

a shape generator in which a plurality of character shapes to be displayed in the respective character blocks are registered in advance, and which outputs, in the numerical order of said pictures, character shape data for one horizontal scan of the character blocks which are designated by the corresponding vertical scanning position address signals in accordance with the character shapes designated by the corresponding character read address signals which are successively input in the numerical order of said pictures before synthesis;

a priority decision circuit for comparing said character shape data for one horizontal scan which are output from said shape generator in the numerical order of said pictures with each other in accordance with predetermined priorities and determining the priority picture for each dot which is to be displayed at the time of a horizontal scan of said raster display; and a character generator in which a plurality of color character data to be displayed in the respective character blocks are registered in advance, and which successively outputs color data for one dot which are specified by the corresponding vertical scanning position address signal and a horizontal scanning position address signal in accordance with said color character data designated by said character read address of said priority picture in synchronization with a scan of said raster display;

said shape generator and said character generator being provided for common use in synthesizing one color picture by placing said plurality of pictures with one on top of another.

2. An image display apparatus according to claim 1, wherein said picture display memory sets each character block of each of said pictures at 8 dots in the horizontal direction and 8 dots in the vertical direction.

3. An image display apparatus according to claim 1, wherein a plurality of said picture display memories and said raster display controllers are provided in correspondence with the number of said pictures used for synthesis.

4. An image display apparatus according to claim 3, wherein at least one of said picture display memories is used for a scroll reference picture which is larger than a picture for a raster display.

5. An image display apparatus according to claim 1, further comprising a picture computing circuit for designating the region of said scroll reference picture which is to be displayed on said raster display, and for outputting the designation signal to the display controller which corresponds to the picture to be displayed; and said picture display memory includes at least one picture display memory used for a scroll reference picture which is larger than a picture for raster display.

6. An image display apparatus according to claim 1, wherein said shape generator uses the technique of time sharing so as to output said character shape data for one horizontal scan in the corresponding character blocks in the respective pictures in the numerical order of said pictures.

7. An image display apparatus according to claim 1, wherein said picture display memory and said display controller use the technique of time sharing so as to compute and output said character read address signals and said vertical scanning position address signals of the respective pictures in the numerical order of said pictures.

8. An image display apparatus according to claim 5, wherein said display controller includes a block address generation circuit for outputting a block address of said scroll reference picture, said block address generation circuit including a horizontal block computing circuit for outputting a signal indicating the horizontal block position of said scroll reference picture, and a vertical position computing circuit for outputting the vertical position of said scroll reference picture.

9. An image display apparatus according to claim 1, wherein said picture display memory includes an RAM in which scroll reference pictures are registered and an RAM in which fixed pictures are registered; and said display controller includes a first block address generation circuit for successively outputting block addresses of the respective scroll reference pictures, a second block address generation circuit for successively outputting block addresses of the respective fixed pictures, a multiplexer for switching and outputting the signals output from said first and second block address generation circuits in the numerical order of said pictures, a picture number generator for generating the number of the picture corresponding to the signal which is output through said multiplexer, and an address computing circuit for computing and outputting said character block address signals and said vertical scanning position address signals of the respective pictures on the basis of the signals output from said multiplexer and said picture number generator, whereby the computed character block address signal is output to the corresponding RAM of said picture display memory, and the computed vertical scanning position address signal is output to said priority decision circuit.

10. An image display apparatus according to claim 9, wherein said first block address generation circuit includes a horizontal block computing circuit for outputting a signal indicating the horizontal block position of said scroll reference picture, and a vertical position computing circuit for outputting the vertical position of said scroll reference picture.

11. An image display apparatus according to claim 10, wherein said horizontal block computing circuit includes a plurality of block displacement latch circuits which are provided in correspondence with said scroll reference pictures and in which displacements relative to the horizontal direction of the corresponding pictures to be displayed are set in blocks, a multiplexer for selectively switching and outputting the outputs of said latch circuits at a predetermined timing, an H counter for increasing the count value by one at the end of every horizontal scan of one block of said raster display, and an adder for adding the output of said H counter and the output of said multiplexer and outputting a signal indicating the block position in the horizontal direction of said scroll reference picture; and said vertical position computing circuit includes a plurality of latch circuits in which the displacements relative to the vertical direction of the corresponding scroll reference picture are set in dots, a multiplexer for selectively outputting the outputs of said latch circuits at a predetermined timing, a V counter for increasing the count value by one at the end of every horizontal scan of the picture to be displayed in said raster display, and an adder for adding the output of said V counter and the output of said multiplexer and outputting a signal indicating the vertical position in said scroll reference picture.

12. An image display apparatus according to claim 1, wherein said priority decision circuit includes a plurality of picture data storage circuits in which are input said address read signals and said vertical scanning position address signals of the respective pictures and said character shape data for one horizontal scan which are output from said shape generator on the respective pictures, a latch circuit in which the priorities of the respective pictures are registered, a priority circuit for comparing the character shape data for one horizontal scan of the corresponding picture with another character shape data in each dot on the basis of the priorities of the respective pictures which are set and registered in said latch circuit so as to determine the picture having the highest priority for each dot, and outputting a selection signal commanding the selection of the picture data storage circuit which corresponds to said picture having the highest priority, and a multiplexer for selecting the signal output from said picture data storage circuit which is designated by said selection signal input at every scan of one dot of said raster display and outputting the selected signal to said character generator.

13. An image display apparatus according to claim 1, wherein said priority decision circuit includes a plurality of picture data storage circuits in which are input said address read signals and said vertical scanning position address signals of the respective pictures and said character shape data for one horizontal scan which are output from said shape generator on the respective pictures, a priority circuit in which the priorities of the respective pictures are registered and which compares the character shape data for one horizontal scan of the corresponding picture with another character shape data in each dot on the basis of the registered priorities of the respective pictures so as to determine the picture having the highest priority for each dot, and outputs a selection signal commanding the selection of the picture data storage circuit which corresponds to said picture having the highest priority, and a multiplexer for selecting the signal output from said picture data storage circuit which is designated by said selection signal input at every scan of one dot of said raster display and outputting the selected signal to said character generator.

* * * * *